US006837706B2

(12) United States Patent
Straetmans et al.

(10) Patent No.: US 6,837,706 B2
(45) Date of Patent: Jan. 4, 2005

(54) UNIT FOR DRYING GYPSUM PLASTER BOARD

(75) Inventors: Cristoph Straetmans, Bad Hersfeld (DE); Ernst-Martin Weichgrebe, Neuenstein (DE)

(73) Assignee: Grenzebach-BSH GmbH, Bad Hersfeld (DE)

( * ) Notice: Subject to any disclaimer, the term of this patent is extended or adjusted under 35 U.S.C. 154(b) by 0 days.

(21) Appl. No.: 10/490,316

(22) PCT Filed: Aug. 23, 2002

(86) PCT No.: PCT/EP02/09434

§ 371 (c)(1),
(2), (4) Date: May 17, 2004

(87) PCT Pub. No.: WO03/025484

PCT Pub. Date: Mar. 27, 2003

(65) Prior Publication Data

US 2004/0248056 A1 Dec. 9, 2004

(30) Foreign Application Priority Data

Sep. 19, 2001 (DE) ..... 101 46 179

(51) Int. Cl.[7] ..... F26B 19/00

(52) U.S. Cl. ..... 432/128; 432/31; 34/210; 34/216

(58) Field of Search ..... 432/128, 137, 432/129, 163, 164, 171, 207, 31; 34/210, 216, 217

(56) References Cited

U.S. PATENT DOCUMENTS

| | | | | |
|---|---|---|---|---|
| 1,399,276 A | | 12/1921 | Roberts | |
| 2,284,838 A | | 6/1942 | Oholm | |
| 2,389,586 A | | 11/1945 | Andrews | |
| 3,863,361 A | * | 2/1975 | Gerhardt | 34/191 |
| 4,050,885 A | * | 9/1977 | Nowick et al. | 432/31 |
| 4,472,887 A | * | 9/1984 | Avedian et al. | 34/496 |
| 4,850,860 A | | 7/1989 | Albonetti | |
| 4,952,145 A | | 8/1990 | Kwiatkowski et al. | |
| 5,659,975 A | * | 8/1997 | Bahner et al. | 34/459 |
| 5,958,330 A | * | 9/1999 | Westman | 266/252 |
| 6,581,302 B1 | * | 6/2003 | Philipp et al. | 34/633 |
| 6,655,041 B1 | * | 12/2003 | Schmidt et al. | 34/218 |

FOREIGN PATENT DOCUMENTS

| | | |
|---|---|---|
| DE | 43 26 877 | 10/1994 |
| GB | 602 526 | 10/1946 |

* cited by examiner

*Primary Examiner*—Gregory Wilson
(74) *Attorney, Agent, or Firm*—Herbert Dubno

(57) ABSTRACT

Modern drying units for gypsum plaster board have a feed device, comprising several roller feed units (1) arranged in levels one above the other. The drying section is generally divided into several zones (3 to 7), in particular three longitudinally ventilated zones (4 to 6), being two high temperature zones (4, 5) and a subsequent low temperature zone (6). Due to the high production capacity of the upline production plant and the necessarily long residence time, drying units are very long. According to the invention, black boards (19) are arranged above and below the individual roller feed units (1) in the high temperature zones (4, 5), which extend across the width of the roller feed units (1). The boards (19) are heated exclusively by means of the flowing drying air to an elevated temperature, and transmit additional heat to the through-flowing gypsum plaster board (16) by radiation. It is possible to reduce the length of the drying unit due to the increased heat transfer coefficient.

16 Claims, 4 Drawing Sheets

UNIT FOR DRYING GYPSUM PLASTER BOARD

The invention relates to an apparatus for drying gypsum board according to the introductory clause of claim 1.

The basic system is described in the book *Trocknungstechnik, 3. Band, Trocknen und Trockner in der Production*" (Translated: *Drying technique, Vol. 3, Drying and Dryers in Production*) by K. Kröll and W. Kast (Springer Verlag 1089; pp. 489 to 493). As described clearly here, modern apparatuses for drying gypsum board are subdivided into several zones to accommodate the particularities of the drying process. A schematic drawing shows an apparatus with a predrying zone, two high-temperature zones, a low-temperature zone, and a cooling zone. In the two high-temperature zones, hot air enters at 250° C., in the low-temperature zone at 160° C. The temperature at the downstream end is between 95° C. and 140° C.

Gypsum-board dryers are usually set up as multilevel dryers. This is necessary to make the drying capacity correspond to the output rate of the upstream production facility operating as a rule at several thousand square meters per hour. Due to the necessary long treatment time of the material—20 to 60 minutes—the drying apparatus is very long. It can be 100 m or more. The two high-temperature zones are for example each 20 to 25 m long, the low-temperature zone 40 to 50 m.

Another drying apparatus with the features of the claim introductory clause is known from German 4,326,877. This apparatus has a predrying zone, two high-temperature zones, and a low-temperature zone. The low-temperature zone is equipped with plate-shaped heat exchangers above and below the individual roller conveyors. Each heat exchanger is comprised for example of a number of juxtaposed tubes that extend parallel to the conveyor direction and that are connected together by transversely extending manifolds. The heat exchangers can also be made like plates that for example are set together in a flat array. The interior of each hollow heat exchanger is fed gases from the high-temperature zones that have a temperature for example of 170° C. Heat is thus transmitted to the gypsum boards both indirectly from the drying air that flows countercurrent to the surfaces of the heat exchangers in the low-temperature zone and directly by radiation from the heat exchangers. In this manner gases vented from the high-temperature zones are used optimally and the heat requirements of the drying apparatus are maintained low.

In the last-named reference there is also in the low-temperature zone a nozzle arrangement for feeding in the drying air. It is constituted generally of a number of nozzles in the form of flat plate-like hollow bodies which are stacked together between the individual roller conveyors. Each hollow body communicates via a lateral slot opening with a distributor or manifold and is provided internally with flow-conducting vanes which deflect the transversely entering drying air through 90° so that this air flows out an end slot parallel to the conveyor direction.

It is an object of the invention to improve on a drying apparatus for gypsum boards that has the features of the introductory clause of claim 1 and where at least in a high-temperature zone the heat exchange from the drying air to the boards being treated is improved and as a result the apparatus can be made shorter.

This object is achieved by the characterizing features of claim 1.

The plates described in the characterizing clause of claim 1 are heated solely by the longitudinally moving hot drying air to a temperature that is substantially higher than the temperature of the passing gypsum boards. As a result of this temperature differential, heat is radiated from the tables to the gypsum boards. The additional radially effective heat exchange depends on several parameters, mainly from the temperature. It increases, as calculations and tests have proven, generally linearly with the temperature of the drying air. With a typical average temperature in a high-temperature zone of 200° C. the heat-exchange rate is increased about 20%. Thus taking as a starting point that the heat exchange rate with purely convective heat exchange is about 40 $W/m^2K$, the radiation effect adds about 50 $W/m^2K$. It is thus possible for example in a drying apparatus that has two high-temperature zones totaling about 42 m long, to reduce length by about 8 m. If the drying apparatus, as is typical, is formed of sections from w to 2.5 m long, in this manner three to four sections can be eliminated.

According to claim 2 there are two high-temperature zones and one low-temperature zone, and both of the high-temperature zones are provided with plates.

Although the additional heat-exchange effect is improved in the low-temperature zone by the slight flow speed of the drying air, it is as a result of the temperature substantially lower. It is therefore a case-by-case decision if the expense for the plates according to the invention is worth it. Since the length of the low-temperature zone is determined by the necessary treatment time, shortening it does not seem essential in many cases. According to claim 3 there are no plates in the low-temperature zone. It can however be advantageous to provide the low-temperature zone with plates according to the invention. The plates allow a reduction of the temperature for the drying air in the low-temperature zone.

The emissions coefficient has a substantial influence on the effect according to the invention. Thus according to claim 4 the plates have a "black" coating, that is a coating whose emissions coefficient is about 1 in the frequency range important for the heat exchange.

According to claim 5 the tables are free of recesses, in particular of channels for a heat-exchange medium fed in from outside. This is markedly different from the plate-shaped heat exchangers that are used in the low-temperature zone according to above-cited German 4,326,877.

Several embodiments of the plates, that are only made of one thickness of material, are described in claims 6 to 10.

According to claims 11 and 12 the plates can be formed of parallel closely juxtaposed tubes. They are however not connected with an external heat-exchange circuit. They have according to the invention the advantage that they are mechanically strong and, in the embodiment of claim 12, have an increased surface area for the drying air flowing along them.

The features of claim 13 facilitate cleaning of the dryer.

The drawing serves for illustrating the invention with reference to a simplified drying apparatus according to the invention.

FIG. 1 schematically shows an apparatus for drying gypsum boards;

Figure 1:
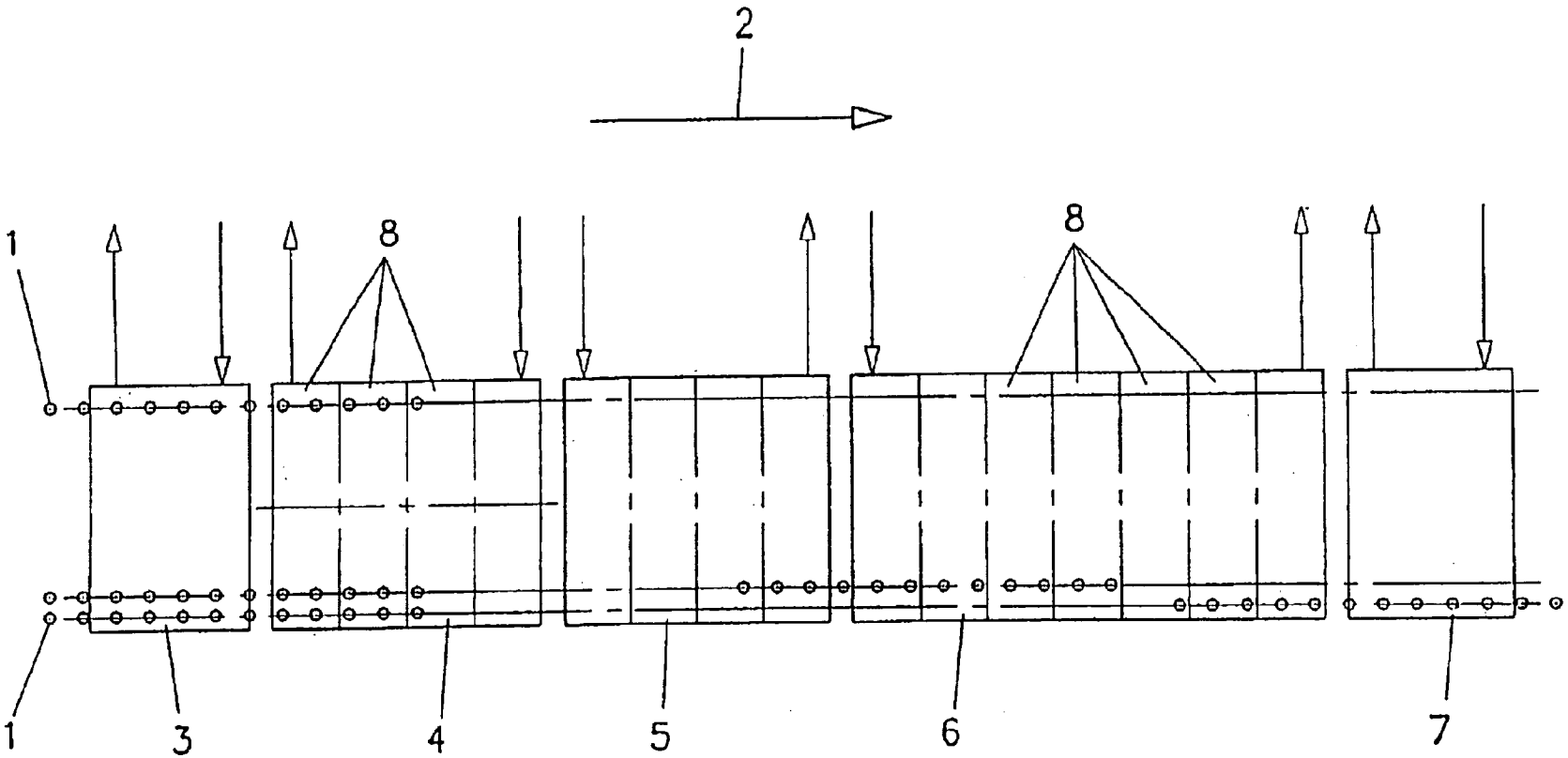

A conveyor formed of a plurality, here ten to twelve, of roller conveyors 1 arranged one above the other in levels extend in a conveyor direction over the entire length of the drying apparatus shown in FIG. 1. The conveyor direction is shown by arrow 2. Spaced apart along the conveyors in the conveyor direction 2 one behind the other are several zones, namely a predrying zone 3, a first high-temperature zone 4, a second high-temperature zone 5, a low-temperature zone 6, and a cooling zone 7. Each zone has its own housing. In particular the housings for the zones 4 to 6 are each formed of several structurally interconnected sections 8 each 2 to 2.5 m long. The zones 4 to 6 can be different from each other with respect to length, that is relative to the number of sections 8. As a rule the low-temperature zone 6 is longer than the two high-temperature zones 4 and 5. Each zone 3 to 7 is provided with devices for feeding in and conducting out drying air as described below. They are connected with an air-handling and heating system, shown by arrows in FIG. 1, which is set up in the standard manner so that the drying air is fed to each individual zone with the temperature, moisture, and speed necessary for the respective drying step. The drying air moves parallel to the conveyor direction 2, in particular inside the zones 4 to 6 as further described in more detail with reference to FIG. 2, more specifically opposite this direction in the first high-temperature zone 4 and in this direction in the second high-temperature zone and in the low-temperature zone 6. The two high-temperature zones 4 and 5 are supplied with drying air at temperatures between 200° and 300° C., the low-temperature zone 6 at a temperature that is substantially below 200° C. and normally under 100° C. The predrying zone 3 and the cooling zone 7 can be for example provided with air-supply nozzles so that the treatment air is projected as perpendicular jets onto the gypsum boards. The zones 3 and 7 are not the subject of this invention.

Figure 2:
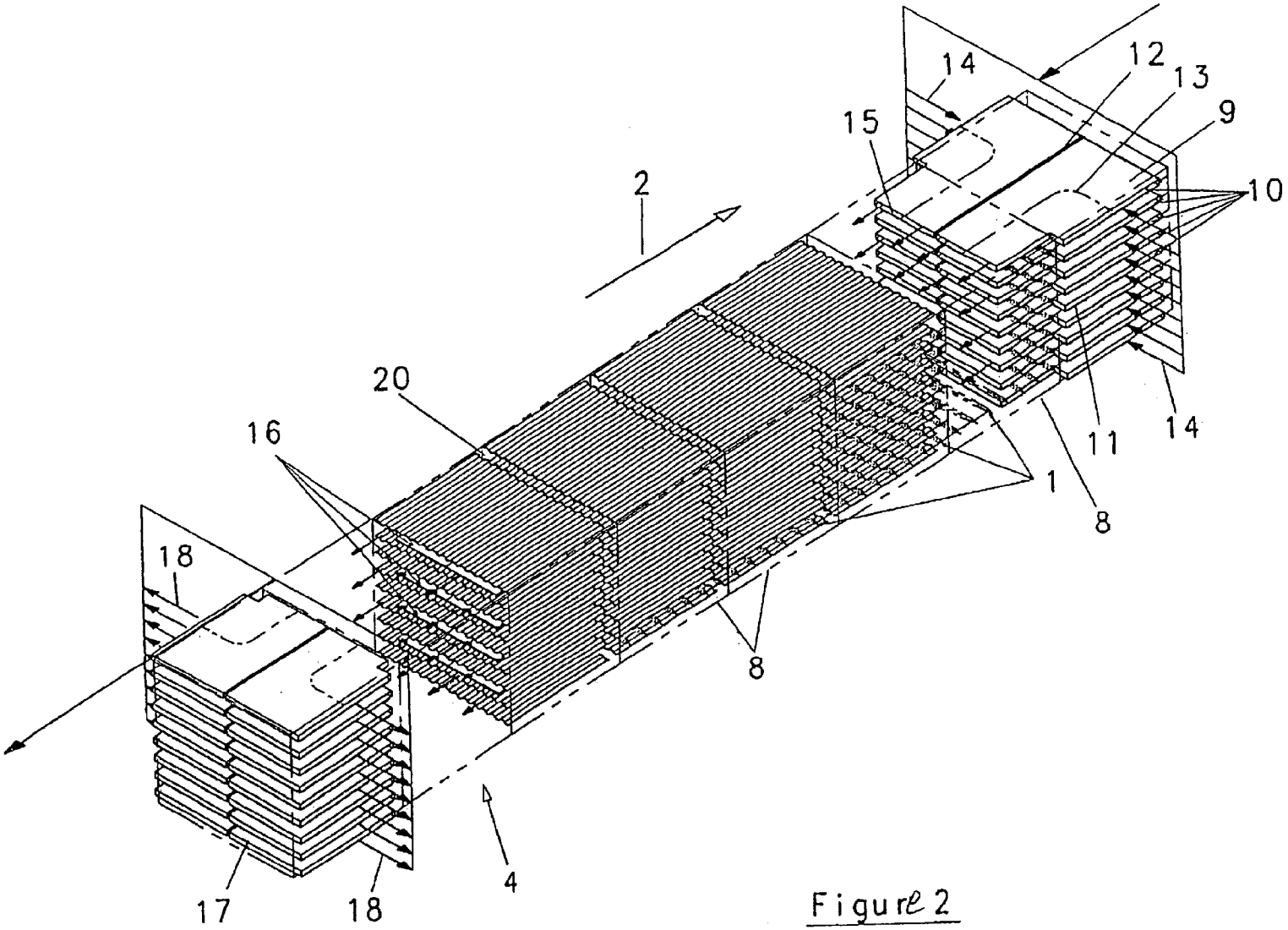
FIG. 2 is a perspective view of the interior of a high-temperature zone.

Seen in the conveyor direction as shown in FIG. 2, at the downstream end of the first high-temperature zone 4 is a nozzle arrangement 9 for feeding in drying air. It is comprised of a plurality of flat plate-shaped nozzles 10 that are spacedly stacked atop one another. The uppermost nozzle 10 is above the uppermost roller conveyor 1, the lowest nozzle 10 is below the lowest roller conveyor 1, and the remaining nozzles 10 are between the individual roller conveyors 1. The nozzles 10 extend longitudinally over about two sections 8. Their transverse dimensions are a little more than the width of the roller conveyors 1. Each nozzle 10 is connected at each side via a slot opening 11 with a vertical manifold that is not visible in the drawing. Inside each nozzle is a partition 12 subdividing its interior into two mirror-symmetrical halves. The two halves have guide vanes 13 that divert the drying air entering transversely as shown at 14 through 90° so that it flows through an end slot opening 15 countercurrent to the passing gypsum boards 16 in the high-temperature zone 4. In this manner the drying air flows over the upper and lower surfaces of the gypsum boards 16 in each level. At the upstream end of the high-temperature zone 4 there is a nozzle arrangement 17 that is generally the same as the nozzle arrangement 9. It draws out air and feeds it into unillustrated lateral connection conduits as shown by arrows 18.

Between the individual roller conveyors 1 as well as above the uppermost roller conveyor and below the lowest roller conveyor there is in all sections 8 except for those with the nozzle arrangements 9 and 17 horizontal plates 19 that extend nearly over the entire width of the roller conveyors 1. In order to avoid overdrying the edges, it is preferable to make the plates 19 somewhat narrower. The plates 19 are secured in lateral supports on which the bearings for the roller conveyors 1 are mounted. Their length, that is their dimension in the conveyor direction 2, is slightly less than the length of a section 8. Thus each level has between the respective plates 8 of adjacent sections a gap 20 that is relative narrow compared to the section length. The gaps 20 of the individual levels are directly vertically aligned so that when the dryer is cleaned the dust that collects on the plates 19 can fall through the gaps 20 to the floor.

The plates 19 are provided with a coating that has in the range of the infrared spectrum which corresponds to the operating temperature of the dryer, an emissions coefficient of about 1. This is used for example also for white body paint that inherently has a relatively low emissions coefficient in the optical frequency range.

The second high-temperature zone 5 is similarly constructed and thus needs no description.

The low-temperature zone 6 can be, seen from the end, constructed similarly to the high-temperature zones 4 and 5. Since however the plates 19, as mentioned above, are only marginally effective as a rule in the low-temperature zone 6 but remain quite expensive, according to a preferred embodiment of the invention there are no such plates in the low-temperature zone 6. Instead of the plates 19, as described in above-mentioned German 4,326,877 heat exchangers can be used with the exhaust gases of the two high-temperature zones 4 and 5 flowing through them.

Figure 3:
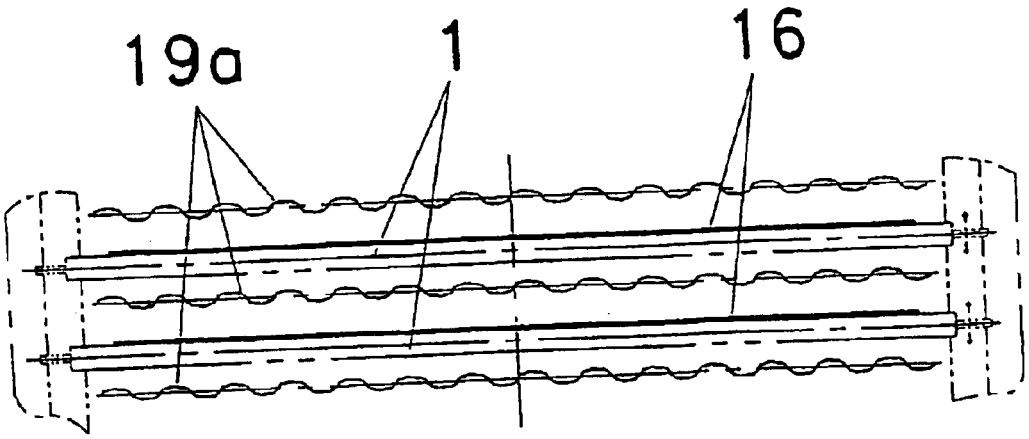
FIGS. 3 through 8 show various embodiments of plates according to the invention.

The plates 19*a* shown in FIG. 3 are corrugated sheet-metal plates whose corrugations extend parallel to the conveyor direction 2. Instead of corrugated sheet-metal plates it is possible to use corrugated fiber-cement plates or the like.

Figure 4:
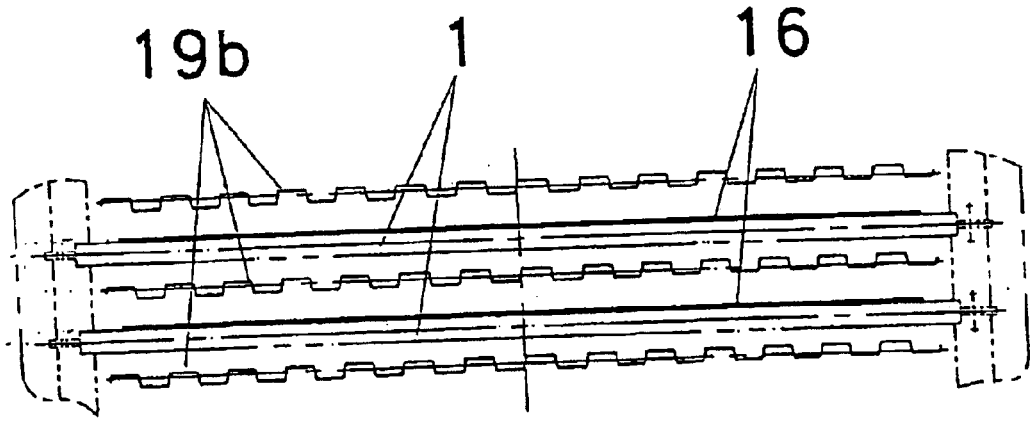

The plates 19*b* shown in FIG. 4 are trapezoidal sheet-metal plates, that is sheet-metal plates that are formed with trapezoidal grooves extending parallel to the conveyor direction 2.

Figure 5:
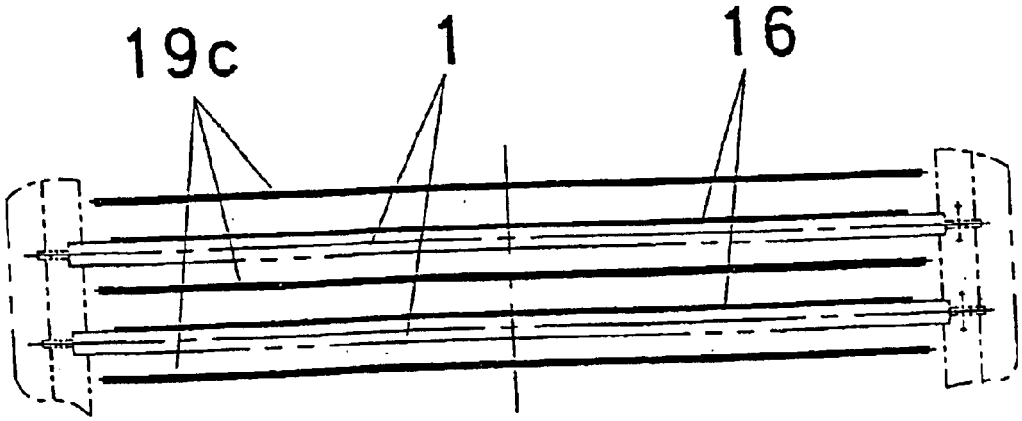

The plates 19*c* shown in FIG. 5 are planar flat sheet-metal plates or fiber-cement plates.

Figure 6:
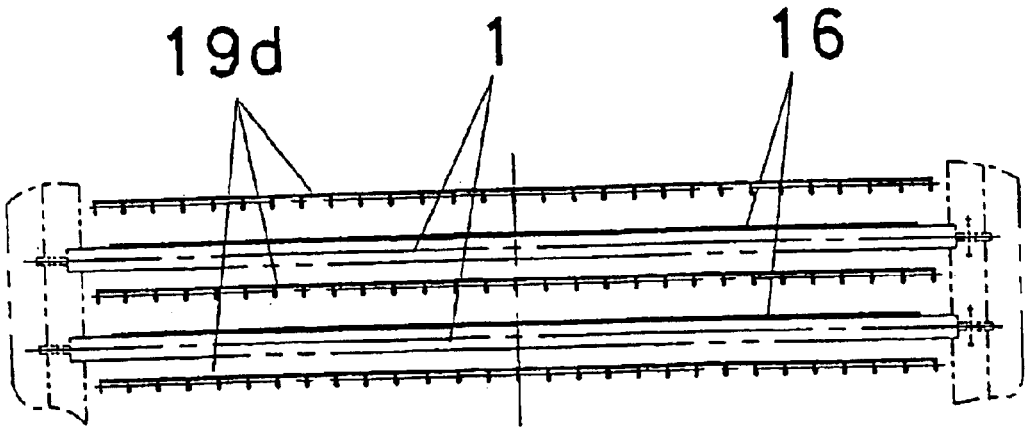

The plates 19*d* shown in FIG. 6 are formed of a plurality of parallel closely joined U-profiles that extend parallel to the conveyor direction 2.

Figure 7:
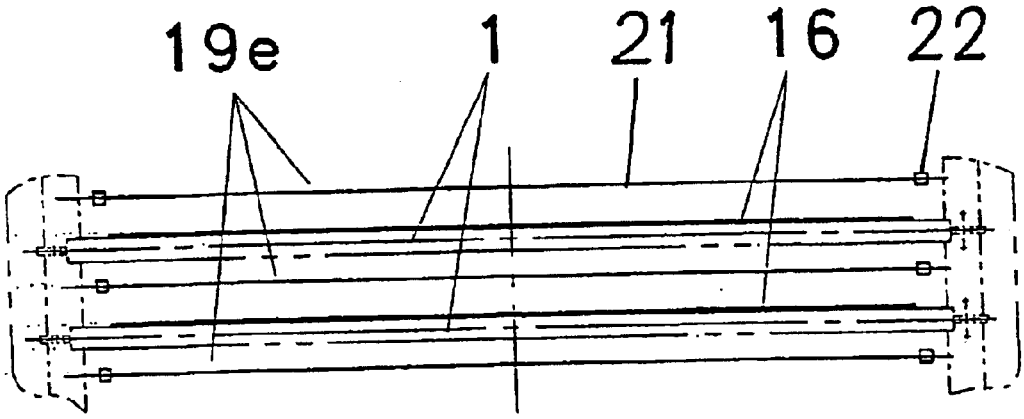

The plates 19*e* shown in FIG. 7 are mesh mats 21 that are supported in frames 22. The mats 21 are made of temperature-resistant fibers, e.g. carbon fibers.

Figure 8:
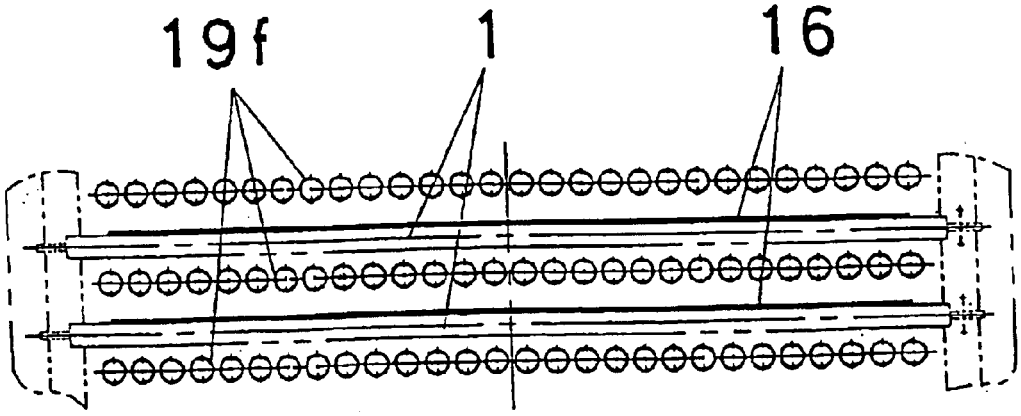

The plates 19*f* shown in FIG. 8 are formed of a plurality of closely juxtaposed parallel tubes with open ends and having axes that extend parallel to the conveyor direction.

What is claimed is:

1. An apparatus for drying gypsum boards, the apparatus comprising:

a plurality of superposed conveyors extending at respective levels in a conveyor direction through an upstream high-temperature zone, a mid-stream low-temperature zone, and a down-stream cooling zone;

means for driving the conveyors and displacing the boards downstream in the direction along the levels through the conveyors;

upstream and downstream nozzles at upstream and downstream ends of each level of the high-temperature zone and of the low-temperature zone;

respective arrays of horizontal heat-radiating plates extending across most of the width and most of the length of each of the levels between the upstream and downstream nozzles in the high-temperature zone; and means for supplying hot air at respective treatment temperatures to some of the nozzles of the high- and low-temperature zones and for with drawing hot air through others of the nozzles of the high- and low-temperature zones, whereby the plates in the high-temperature zone are heated by the hot air from the nozzles and radiate the heat to the boards passing at the respective levels.

2. The gypsum-board drying apparatus defined in claim 1 wherein the conveyors define two such upstream high-temperature zones following each other in the direction upstream of the low-temperature zone and each such high-temperature zone has at each level respective upstream and downstream nozzles connected to the air-supply means, both of the high-temperature zones being provided with the heat-radiating plates.

3. The gypsum-board drying apparatus defined in claim 1 wherein there are a plurality of the plates at each level of the high-temperature zone and the plates of each level are generally coplanar and spaced from each other by gaps in the direction of the conveyor.

4. The gypsum-board drying apparatus defined in claim 1 wherein the low-temperature and cooling zones are not provided with the heat-radiating plates.

5. The gypsum-board drying apparatus defined in claim 1 wherein the plates are provided with a surface coating having an emissions coefficient of about 1.

6. The gypsum-board drying apparatus defined in claim 1 wherein the plates have corrugations.

7. The gypsum-board drying apparatus defined in claim 6 wherein the corrugations extend parallel to the direction.

8. The gypsum-board drying apparatus defined in claim 6 wherein the corrugations are of trapezoidal section.

9. The gypsum-board drying apparatus defined in claim 1 wherein the plates are of sheet metal.

10. The gypsum-board drying apparatus defined in claim 1 wherein the plates are planar and flat.

11. The gypsum-board drying apparatus defined in claim 1 wherein the plates are each made of a plurality of closely juxtaposed and parallel U-profiles.

12. The gypsum-board drying apparatus defined in claim 11 wherein the mat is made of carbon fibers.

13. The gypsum-board drying apparatus defined in claim 1 wherein each plate is comprised of a mesh mat and a tension frame holding the mat.

14. The gypsum-board drying apparatus defined in claim 1, wherein each plate is made of a plurality of closely juxtaposed tubes extending in the direction.

15. The gypsum-board drying apparatus defined in claim 14 wherein each tube has a pair of opposite open ends.

16. The gypsum-board drying apparatus defined in claim 1 wherein at least one of the heat-radiating plates is provided above the uppermost conveyor of the high-temperature zone and another of the heat-radiating plates is provided below the lowest conveyor of the high-temperature zone.

* * * * *